US008835818B2

(12) United States Patent
Anthony et al.

(10) Patent No.: US 8,835,818 B2
(45) Date of Patent: Sep. 16, 2014

(54) SELF-REGULATING HEATER

(75) Inventors: John E. Anthony, Derby (GB); Alexis Lambourne, Belper (GB)

(73) Assignee: Rolls-Royce PLC, London (GB)

( * ) Notice: Subject to any disclaimer, the term of this patent is extended or adjusted under 35 U.S.C. 154(b) by 358 days.

(21) Appl. No.: 12/850,954

(22) Filed: Aug. 5, 2010

(65) Prior Publication Data

US 2011/0049130 A1 Mar. 3, 2011

(30) Foreign Application Priority Data

Aug. 27, 2009 (GB) ..... 0914907.1

(51) Int. Cl.
*H05B 3/34* (2006.01)
*H05B 3/54* (2006.01)

(52) U.S. Cl.
CPC ..... *H05B 3/34* (2013.01); *H05B 2203/013* (2013.01); *H05B 2203/02* (2013.01); *H05B 2203/033* (2013.01); *H05B 2203/005* (2013.01); *H05B 2203/017* (2013.01)
USPC ..... 219/549; 219/542; 219/544; 219/546; 219/548

(58) Field of Classification Search
USPC ..... 219/544, 542, 546, 549
See application file for complete search history.

(56) References Cited

U.S. PATENT DOCUMENTS 3,940,591 A * 2/1976 Ting ..... 219/544
4,368,380 A * 1/1983 Igashira et al. ..... 219/539
4,937,435 A 6/1990 Goss et al.
6,278,092 B1 * 8/2001 Wu ..... 219/549
2002/0003136 A1 1/2002 Williamson et al.
2009/0174521 A1 7/2009 Ihle et al.
2009/0179731 A1 7/2009 Ihle et al.

FOREIGN PATENT DOCUMENTS

DE 29 48 593 A1 6/1981
DE 10 2007 055 015 A1 6/2008
WO WO 2008/009282 A2 1/2008
WO WO 2008/009283 A1 1/2008
WO WO 2009/027217 A1 3/2009

OTHER PUBLICATIONS

European Search Report dated Dec. 19, 2010 in corresponding European Patent Application No. 10 172 013.4.
British Search Report issued in British Application No. GB0914907.1 dated Dec. 18, 2009.

* cited by examiner

*Primary Examiner* — Nitin Parekh
(74) *Attorney, Agent, or Firm* — Oliff PLC

(57) ABSTRACT

There is disclosed a self-regulating electric heater assembly arranged to heat an electrically conductive substrate such as a flexible substrate of shape memory alloy for use as an actuator. The heater assembly comprises a plurality of substantially rigid PTC elements arranged in spaced-apart relation to one another in a flexible array, said PTC elements each having a contact surface arranged in contact with the substrate and being urged against said substrate so as to remain in contact with the substrate upon flexure of the substrate. The substrate serves as one of a pair of electrical conductors electrically connected to the PTC elements for the supply of electric current to the PTC elements.

16 Claims, 3 Drawing Sheets

SELF-REGULATING HEATER

The present invention relates to self-regulating heaters.

Flexible heating mats formed from silicone, kapton and other such rubbers and polymers are widely known and are commonly used in many technical fields. Such mats typically comprise a heating element formed of wound wire or an etched foil element which is encapsulated between two layers of suitable material. Flexible heating mats of this type can be made very thin (typically less than 2 mm thick), can operate at high temperatures (over 200° C.) and can be conveniently applied to flat or curved surfaces, and so are commonly used in many different applications to apply heat to a localised area of a target substrate.

Positive Temperature Coefficient (PTC) materials (also sometimes referred to as Positive Temperature Coefficient of Resistivity (PTCR) materials) are also widely known and are used in various technical fields. PTC materials exhibit special properties in relation to electrical conductivity and temperature. When an electric current is passed through a material exhibiting a PTC characteristic, the temperature of the material increases by ohmic heating up to a transition temperature (commonly known as the Curie temperature of the material), at which point the temperature of the material then remains static. This phenomenon occurs because any further small increase in temperature above the Curie temperature causes a very large increase in resistivity of the material and hence a decrease in current, which results in reduced ohmic heat dissipation, and so the temperature of the material drops back down. PTC materials therefore display a very useful characteristic in that they self-regulate their temperature, eliminating the need for temperature measurement, feedback and control systems. This has many advantages over more complicated thermostat-controlled heating arrangements, such as cost-saving, weight-saving, reduced part count, improved reliability and simplicity.

Materials exhibiting a PTC characteristic are generally semiconducting titanate ceramic materials. One commonly used example of such a PTC material is barium titanate ($BaTiO_3$). The material properties of Barium titanate and its processing techniques are well understood, and so barium titanate elements are commonly used in many applications where regulated heating is required.

Barium titanate elements are generally sintered from nanoparticle powder, and are readily available in rectangular blocks or discs with widths and lengths in the range of 5 mm to 40 mm, and thicknesses in the range of 1.6 mm to 3 mm. The Curie temperature and PTC characteristic of such elements can be accurately set using dopants (such as Sr, Pb, Zr, Hf, Sn) and by control of appropriate pre-cursor ceramic particle size and sintering conditions (temperature, pressure, duration etc.) which dictate the resultant sintered grain size and microstructure. Because electrical current is passed through the thickness of the barium titanate element, between two opposed surfaces of the element, during operation the element, the surfaces are often sputtered with a thin-film of aluminium (or other metal such as Nickel or gold) to provide reliable electrical contact between the element and an adjacent electrical conductor.

As will be appreciated, although PTC elements of the general type discussed above perform well as self-regulating heating elements, they exhibit typical ceramic properties and so are mechanically both weak and brittle.

Whilst flexible heating mats have been proposed which are made from flexible materials which themselves exhibit a PTC characteristic, this is still a largely experimental area of technology and such mats can only operate up to temperatures significantly below those possible with conventional (i.e. non-PTC) heating mats. Such flexible PTC mats also have a significantly reduced power density compared to conventional non-PTC mats.

It is an object of the present invention to provide an improved self-regulating electric heater.

According to the present invention, there is provided a flexible self-regulating electric heater assembly arranged to heat an electrically conductive substrate, the heater assembly comprising: a plurality of substantially rigid PTC elements arranged to define gaps between one another in a flexible array, said PTC elements each having a contact surface arranged in free contact with the substrate and being urged against said substrate so as to remain in contact with the substrate upon flexure of the substrate, said substrate serving as a conductor for the supply of electric current to the PTC elements.

The electrically conductive substrate may take any convenient form. However, this invention is particularly well suited for use in heating a substrate formed from shape memory alloy (SMA). For example, it is envisaged that such an SMA substrate could be used as an actuator, operable via selective heating of the alloy via the heating assembly of the invention.

Preferably, the PTC elements are held in a flexible matrix of thermally and electrically insulating potting material.

Advantageously, the potting material is substantially elastomeric, and it preferably comprises silicone. However, other rubber or polymeric substances may also be used.

The potting material may at least partially fill the gaps defined between adjacent said PTC elements.

In preferred arrangements, the gaps defined between adjacent PTC elements each define a void adjacent said substrate.

Alternatively, however, said potting material may substantially completely fill the gaps defined between adjacent said PTC elements. In such an arrangement, it is preferable that the potting material filling said gaps is not affixed or secured to said substrate. However, in other embodiments, the potting material filling said gaps can be affixed to said substrate. For example, the potting material filling said gaps may be vulcanized to said substrate.

In some embodiments of the invention, the potting material bears against a substantially rigid member provided in spaced relation to said substrate.

In other embodiments, it is envisaged that a region of said potting material spaced from said substrate may have a structure embedded within it which is configured to stabilise the potting material. Such a stabilising structure could be, for example, an embedded cloth formed from woven glass-fibres or the like.

It is envisaged that in some embodiments, said PTC elements will be urged into direct contact with the substrate. However, in other arrangements, a thin layer of electrically and thermally conductive and non-curing paste may be provided between the PTC elements and the substrate.

The PTC elements are preferably ceramic, and are most preferably formed of a titanate ceramic such as barium titanate.

Each said PTC element may comprise a pair of thin-film electrodes, one of which is sputtered onto said contact surface, and the other of which is sputtered onto an opposing surface of the element.

The heater assembly of the present invention may further comprise an electrical conductor arranged in electrical connection with a second surface of each PTC element, each said second surface being defined on an opposite side of the respective PTC element to said contact surface.

Preferably, the or each said electrical conductor is urged against a respective said PTC element so as to remain in contact with said second surface of the element during relative movement or deflection between the conductor and the element.

So that the invention may be more readily understood, and so that further features thereof may be appreciated, embodiments of the invention will now be described by way of example with reference to the accompanying drawings in which.

Figure 1:
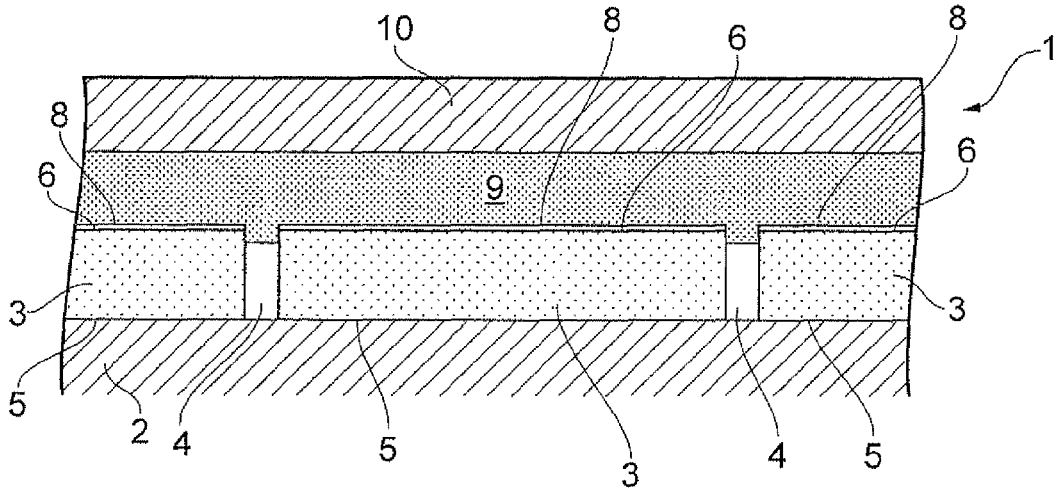
FIG. 1 is a schematic cross-sectional view taken through part of a heater assembly in accordance with a first embodiment of the present invention.

Turning now to consider FIG. 1 in more detail, there is illustrated an electric heater assembly 1 arranged to heat an electrically conductive target substrate 2. The substrate is substantially flexible and will typically be formed of metal. For example, it is envisaged that the target substrate 2 may be formed of SMA and may thus be configured to change shape when heated (and then subsequently allowed to cool) under the control of the heater assembly 2, thereby being particularly suitable for use as an actuator as will be described in more detail hereinafter.

The heater assembly comprises a plurality of rigid PTC elements 3 arranged in spaced-apart relation to one another, such that a gap 4 is defined between each pair of adjacent elements 3. The PTC elements of the specific arrangement illustrated are generally rectangular in form and each has a downwardly directed first planar contact surface 5 arranged in contact with the uppermost surface of the target substrate 2, and an upwardly directed second planar surface 6 on the opposite side of the element. In the arrangement illustrated in FIG. 1 the first contact surface 5 of each PTC element 3 is arranged in direct and substantially free contact with the substrate 2, meaning that a degree of relative movement is permitted between the PTC elements and the substrate. In particular, free contact means that relative sliding movement is permitted between the PTC elements 3 and the substrate 2 such that no or very little strain is imparted in the PTC elements 3 on flexure of the substrate 2. Thus the assembly 1 is flexible and does not hinder flexure of the substrate 2.

Figure 2:
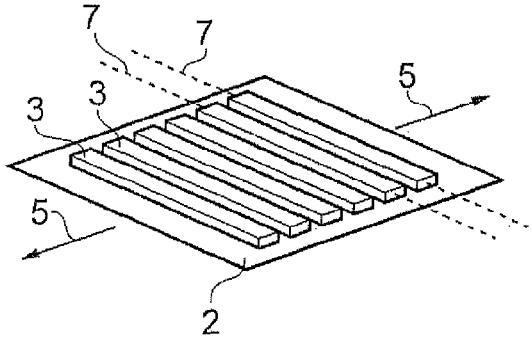
FIG. 2 is a perspective view showing part of the heating assembly of FIG. 1 under strain.
Figure 3:
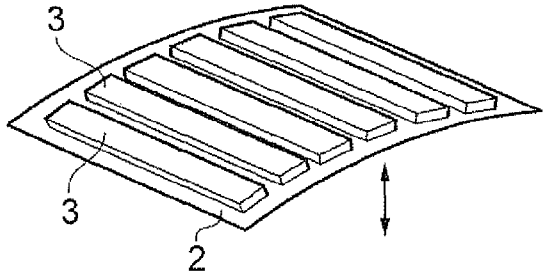
FIG. 3 is a view corresponding generally to that of FIG. 3, but showing the heating assembly in a deflected condition.

As shown in FIGS. 2 and 3, the PTC elements are arranged so that their longitudinal axes 7 lie substantially parallel to one another and substantially perpendicular to the intended direction of strain S applied to the SMA substrate 2 when it is heated and hence deflected (as shown in exaggerated form for illustrative purposes in FIG. 3).

The PTC elements are intended to be thin (typically in the range of 1 to 3 mm thick between the opposed contact surfaces 5,6), and are preferably formed from a suitable titanate ceramic such as barium titanate. The first and second contact surfaces 5,6 of each PTC element each preferably have a thin layer of electrically conductive material such as aluminium sputtered on to them during manufacture of the PTC elements.

The upper contact surface 6 of each PTC element is provided in electrical connection with an electrical conductor 8 which is preferably formed from stainless steel or another corrosion-resistant metal. In the particular arrangement illustrated, each PTC element is provided with a separate respective conductor 8. However, it is to be appreciated that in variants of the invention, the PTC elements could all be arranged in electrical connection with a single, common conductor. In preferred arrangements, the or each conductor 8 is provided in substantially free contact with the PTC element in the sense that a degree of relative movement is permitted between the conductor and the upper contact surface 6 without the electrical connection between the two being broken. Free contact here preferably means that at least relative sliding movement is permitted between the PTC elements 3 and the conductor 8 such that no or very little strain is imparted in the PTC elements 3 on flexure of the substrate 2. However, it is also possible to fixedly connect the conductor to the upper contact surface 6, for example via soldering or the use of a curable electrically conductive paste or the like.

The upper region of each PTC element 3, and its associated conductor 8, is embedded in a flexible matrix of thermally and electrically insulating potting material 9 which is provided as a thin layer over the top of the PTC elements. The potting material 9 thus serves to hold the PTC elements in a flexible array. As will be noted from FIG. 1, in this embodiment the potting material does not extend very far downwardly into the gaps 4 between adjacent PTC elements, and so each gap effectively defines a void adjacent the target substrate 2.

The potting material 9 is elastomeric and is preferably silicone rubber. However, other flexible rubbers or polymeric materials could be used instead, or in combination with silicone rubber.

A substantially rigid member 10 is provided in fixed and spaced relation to the target substrate 2, so as to lie across the top of the layer of potting material 9. The potting material 9 is slightly compressed by the rigid member 10, and thus bears against the rigid member 10 so as to resiliently bias the PTC elements 3 against the target substrate 2. The PTC elements 3 are thus urged against the substrate 2 so as to remain in contact with the substrate as it is caused to deflect and strain under the heating action of the PTC elements 2.

As will be appreciated, the lower contact surface 5 of each PTC element makes an electrical connection to the target substrate 2. Because the substrate 2 is electrically conductive, it may therefore be used as an electrode for the supply of electric current across the PTC elements. The PTC effect of the elements 3 is thus stimulated by the application of electric current, via the target substrate 2 and the conductors 8, across each PTC element.

As the PTC elements 3 increase in temperature upon the application of an electric current across their contact surfaces 5, 6 (via the target substrate 2 and the top conductors 8), they serve to heat the target substrate. In the case of the target substrate being provided in the form of a shape memory alloy, the substrate will thus be caused to deflect in response to the application of heat. Also, the increase in temperature of the PTC elements will serve to heat the layer of potting material in which they are held, thereby causing it to expand. Expansion of the potting material is constrained in the vertical sense (in the orientation illustrated in FIG. 1) by the rigid member 10, and so the expansion will occur generally downwardly towards the target substrate 2, thereby pushing the PTC elements 3 against the target substrate and thus ensuring that good thermal and electrical contact between the PTC elements and the substrate is preserved. As the potting material is expanded in this way, it will tend to be pressed into the voids defined by the gaps 4 between adjacent PTC elements (and also to bulge outwardly in a direction generally parallel to the plane of the substrate 2, i.e generally out of the page as viewed in FIG. 1).

The thermal expansion properties of rubbers and polymers tend to be much greater than those of metals, which are typically <20 ppm/° C. (e.g. 5 ppm/° C. in the case of titanium). For silicone rubber, the linear thermal expansion is approximately 330 ppm/° C., and the volumetric expansion is approximately 990 ppm/° C. This means that increasing the temperature of the potting material 9 by 150° C. will result in a linear expansion (if unconstrained) in all directions by 4.5%, which is very significant. Expansion of the potting material 9 in the manner described above is thus very effective in maintaining good thermal and electrical contact between the PTC elements 3 and the target substrate 2.

Because the PTC elements 3 are each provided in direct contact with the substrate 2, without actually being affixed to the substrate, the arrangement permits small amounts of microscopic movement between the substrate and the PTC elements to occur when the substrate is strained and/or slightly curved under the heating action of the PTC elements. This prevents the relatively brittle PTC elements from being strained themselves, whilst allowing good thermal and electrical connection between the PTC elements and the substrate.

In some arrangements, it may be beneficial to provide a thin layer of thermally and electrically conductive (heat-sink) paste between the PTC elements 3 and the target substrate 2 in order to ensure that good thermal and electrical connection is maintained as the curvature of the substrate changes. Suitable pastes for this purpose are known from use in power ICs and transistors, and typically contain very high percentage weights of silver or graphite particulate. If a paste of this type is used between the PTC elements 3 and the substrate 2 (or indeed between the PTC elements 3 and the conductors 8), it is important that the paste does not cure because if it were to cure then the PTC elements would become affixed to the substrate thereby preventing relative movement between the elements and the substrate as mentioned above.

Figure 4:
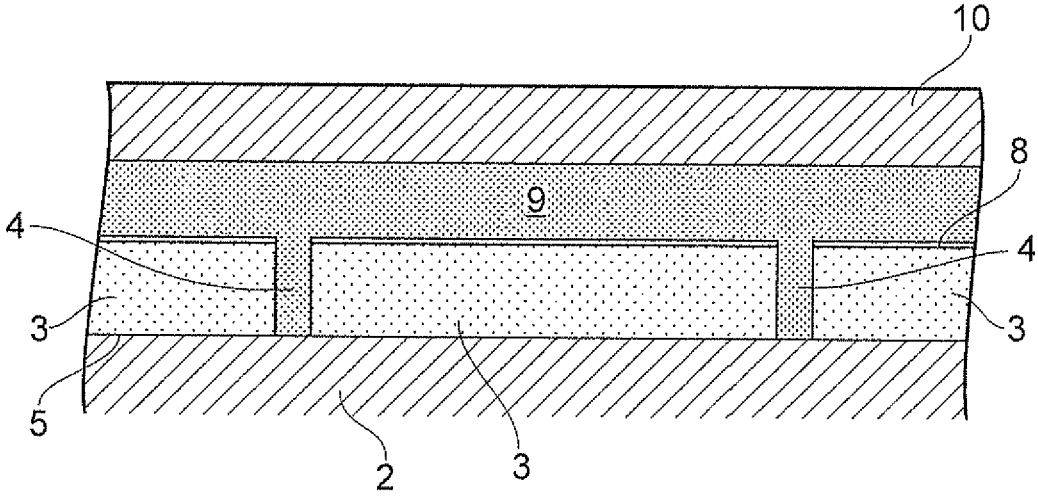
FIG. 4 is a schematic cross-sectional view taken through part of a heater assembly in accordance with a second embodiment of the present invention.

Turning now to consider FIG. 4, there is illustrated a heater arrangement in accordance with another embodiment of the present invention, being a slight modification of the embodiment described above and as illustrated in FIG. 1. The arrangement of FIG. 4 is substantially identical to the arrangement of FIG. 1 in many respects. However, in the FIG. 4 arrangement, the potting material 9 fills the gaps 4 and thus makes contact with the target substrate in the regions of the gaps 4. In the preferred arrangement, the potting material 9 filling the gaps 4 is not affixed or secured to the substrate 2 and is thus able to move relative to the substrate. In this arrangement, it will thus be appreciated that the PTC elements 3 are each more deeply embedded in the matrix of potting material 9.

As the potting material 9 of the FIG. 4 arrangement is heated by the PTC elements, it will of course expand. Expansion of the potting material is constrained in the vertical sense (in the orientation illustrated in FIG. 4) by the rigid member 10, and so the expansion will occur generally downwardly towards the target substrate 2, thereby pushing the PTC elements 3 against the target substrate and thus ensuring that good thermal and electrical contact between the PTC elements and the substrate is preserved, in a similar manner to that of the FIG. 1 arrangement. However, in the arrangement of FIG. 4, the potting material will not have room to move downwardly into the spaces between adjacent PTC elements and so will only be allowed to bulge outwardly in a direction generally parallel to the plane of the substrate 2, i.e generally out of the page as viewed in FIG. 4. It is thought that this may provide improved thermal and electrical contact between the PCT elements and the substrate. However, because this arrangement requires the gaps 4 to be large enough to accommodate an amount of potting material, the PTC elements may not be quite so densely packed. In the arrangement of FIG. 1, the gaps 4 can be made smaller because they do not need to accommodate any potting material, thereby allowing more PTC elements to be provided across a given area of the target substrate 2.

Figure 5:
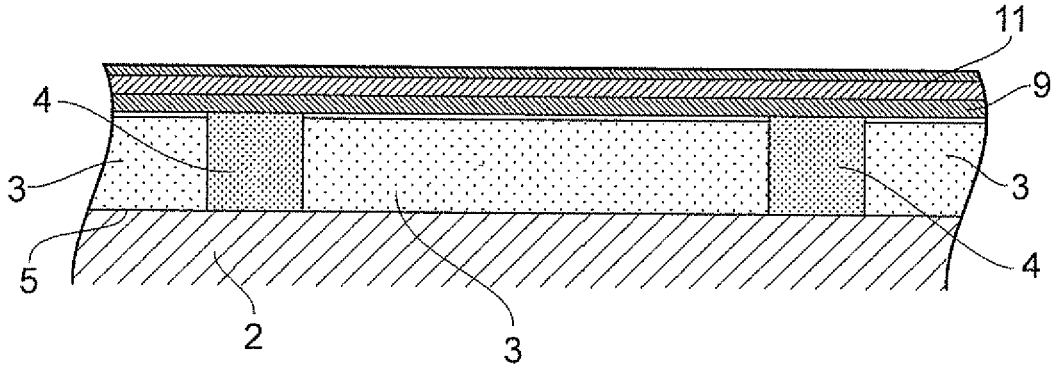
FIG. 5 is a schematic cross-sectional view taken through part of a heater assembly in accordance with a third embodiment of the present invention.

Turning now to consider FIG. 5, there is illustrated a heater arrangement in accordance with a further embodiment of the present invention. In this arrangement, the PTC elements are spaced further apart and so the gaps 4 between adjacent elements are larger than in the embodiments of FIGS. 1 and 4. Also, it will be seen that in the arrangement of FIG. 5, there is no separate rigid member in fixed and spaced relation to the target substrate. Instead, the potting material 9 (which again most preferably comprises silicone rubber) has a thin stabilising structure 11 embedded within it. The stabilising structure 11 is provided in spaced relation to the target substrate 2 and lies across the top of the PTC elements 3 (in the orientation illustrated in FIG. 5). It is proposed that the stabilising structure could be provided in the form of a woven glass-fibre cloth. However, it is envisaged that alternative arrangements may incorporate a cloth woven from Kevlar fibres or carbon fibres instead of glass-fibres.

As will be appreciated, in the absence of the separate fixed rigid member 10 of the previous embodiments, the matrix of potting material 9 must be secured to the target substrate 2 in order secure the embedded stabilising structure 11 with respect to the substrate. This is achieved by affixing the regions of potting material filling the gaps 4 directly to the target substrate 2. Because it has been found that intermediate adhesive compounds provided between the potting material and the target substrate are generally less flexible than the silicone potting material, it is considered preferable to affix the potting material 9 to the substrate 2 by directly vulcanizing the silicone rubber onto the substrate in the regions of the gaps 4. This technique has been found to provide a particularly strong and flexible bond between the silicone rubber potting material and the target substrate.

During operation of the heater arrangement of FIG. 5, the potting material 9 will again be heated directly by the embedded PTC elements 3, and will thus expand. The region of the potting material lying between the stabilising structure 11 and the substrate 2 will thus be constrained by the stabilising structure 11 and will thus serve to press the PTC elements towards the substrate 2 and into firm contact therewith.

The heater arrangements of any of the above-described embodiments may be conveniently provided in the form of flexible heating mats having a thickness in the region of 1.7 mm and 3.7 mm, for use in heating a target substrate 2 in any convenient technical field.

Figure 6:
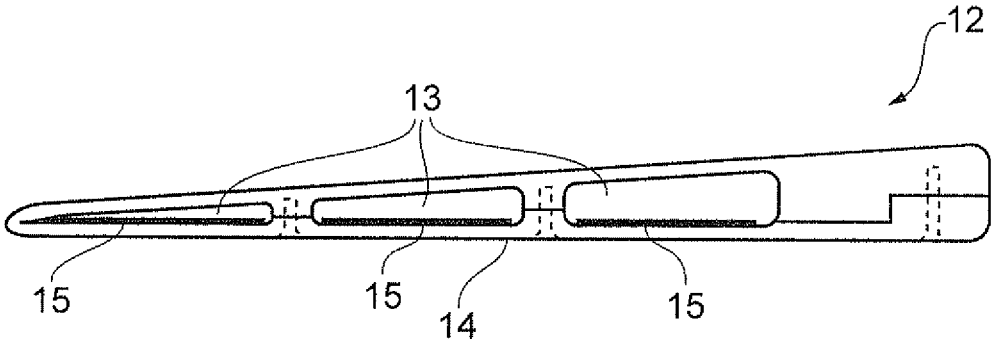
FIG. 6 shows a heater assembly in accordance with the present invention configured to heat part of a shape memory (SMA) actuator.

By way of example, FIG. 6 shows an actuator 12 which is formed of shape memory alloy (SMA) and which may be used as part of a variable-area-nozzle arrangement in a gas turbine engine. The actuator has a series of internal spaces or cells 13 provided above a thin region of alloy defining an outwardly directed surface 14. A flexible heater mat 15 in accordance with the present invention is provided within each cell 13, each mat being arranged against the thin region of alloy in accordance with any of the above-described embodiments. The thin region of alloy defining the outwardly directed surface 14 thus represents the target substrate 2 of the embodiments shown in FIGS. 1 to 5. As will thus be appreciated, operation of the heater mats 15 via the application of electric current across the PTC elements of the mats, using the alloy of the actuator 12 itself as a conductor, will be effective to heat the surface 14 and hence cause it to change shape and deflect. Deflection of the actuator 12 in this manner is used to operate the variable area nozzle arrangement of the gas turbine engine.

Whilst the invention has been described above with reference to specific embodiments, it is to be appreciated that modifications can be made, without departing from the scope of the present invention. For example, whilst the invention has been described above with specific reference to embodiments in which the flexible matrix of potting material 9 serves to resiliently bias the PTC elements 3 against the target substrate 2, in variants of the invention a mechanical spring arrangement could be used for this purpose instead.

Furthermore, in some embodiments where insufficient thermal and electrical connection is found to be provided between the PCT elements 3 and the target substrate 2, then rather than using an intermediate conductive paste as proposed above, it envisaged that the potting material 9 may be provided in the form of a silicone rubber compound loaded with thermally and electrically conductive particles (such as silver or carbon), or may include a thin sheet of carbon or graphite, or carbon fibres. This type of arrangement would avoid any problems associated with the use of a conductive paste, such as migration of the paste over time causing a reduction in conduction between the PTC elements 3 and the substrate 2.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A flexible self-regulating electric heater assembly arranged to heat an electrically conductive shape memory alloy substrate, the heater assembly comprising: a plurality of substantially rigid PTC (positive temperature coefficient) elements arranged to define gaps between one another in a flexible array, wherein:

the PTC elements each has a contact surface arranged in free contact with the substrate and being urged against the substrate so as to remain in direct contact with the substrate upon flexure of the substrate, the substrate serves as a conductor for the supply of electric current to the PTC elements, and the PTC elements are held in a flexible matrix of thermally and electrically insulating potting material, and the PTC elements are resiliently biased against the substrate by the thermally and electrically insulating potting material during flexing of the shape memory alloy substrate.

2. A heater assembly according to claim 1, wherein said potting material is substantially elastomeric.

3. A heater assembly according to claim 1, wherein said potting material at least partially fills the gaps defined between adjacent said PTC elements.

4. A heater assembly according to claim 1, wherein the gaps defined between adjacent PTC elements each define a void adjacent said substrate.

5. A heater assembly according to claim 1, wherein said potting material substantially completely fills the gaps defined between adjacent said PTC elements.

6. A heater assembly according to claim 5, wherein the potting material filling said gaps is not affixed or secured to said substrate.

7. A heater assembly according to claim 5, wherein the potting material filling said gaps is affixed to said substrate.

8. A heater assembly according to claim 1, wherein said potting material bears against a substantially rigid member provided in spaced relation to said substrate.

9. A heater assembly according to claim 1, wherein a region of said potting material spaced from said substrate has a structure embedded therein which is configured to stabilise the potting material.

10. A heater assembly according to claim 1, wherein said PTC elements are urged into direct contact with the substrate.

11. A heater assembly according to claim 1, wherein a thin layer of electrically and thermally conductive paste is provided between said PTC elements and said substrate.

12. A heater assembly according to claim 1, further comprising an electrical conductor arranged in electrical connection with a second surface of each PTC element, each said second surface being defined on an opposite side of the respective PTC element to said contact surface.

13. A heater assembly according to claim 12, wherein the or each said electrical conductor is urged against a respective said PTC element so as to remain in contact with said second surface of the element during relative movement or deflection between the conductor and the element.

14. A flexible self-regulating electric heater assembly arranged to heat an electrically conductive shape memory alloy substrate, the heater assembly comprising: a plurality of substantially rigid PTC elements arranged to define gaps between one another in a flexible array, wherein:

the PTC elements each have a contact surface arranged in free contact with the substrate and being urged against the substrate so as to remain in contact with the substrate upon flexure of the substrate, the substrate serves as a conductor for the supply of electric current to the PTC elements, the free contact permits at least relative sliding movement between the PTC elements and the conductor such that no or very little strain is imparted in the PTC elements on flexure of the substrate, the PTC elements are held in a flexible matrix of thermally and electrically insulating potting material, and the PTC elements are resiliently biased against the substrate by the thermally and electrically insulating potting material during flexing of the shape memory alloy substrate.

15. A heater assembly according to claim 14, wherein a thin layer of electrically and thermally conductive paste is provided between said PTC elements and said substrate.

16. A heater assembly according to claim 14, further comprising an electrical conductor arranged in electrical connection with a second surface of each PTC element, each said second surface being defined on an opposite side of the respective PTC element to said contact surface.

* * * * *